US008203271B2

(12) United States Patent
Shirakawa et al.

(10) Patent No.: US 8,203,271 B2
(45) Date of Patent: Jun. 19, 2012

(54) METAL HALIDE LAMP INCLUDING SEALED METAL FOIL

(75) Inventors: Osamu Shirakawa, Ehime (JP); Hidehiko Noguchi, Ehime (JP)

(73) Assignee: Harison Toshiba Lighting Corporation, Ehime (JP)

( * ) Notice: Subject to any disclaimer, the term of this patent is extended or adjusted under 35 U.S.C. 154(b) by 285 days.

(21) Appl. No.: 12/159,229

(22) PCT Filed: Jan. 26, 2007

(86) PCT No.: PCT/JP2007/051310

§ 371 (c)(1),
(2), (4) Date: Jun. 30, 2010

(87) PCT Pub. No.: WO2007/086527

PCT Pub. Date: Aug. 2, 2007

(65) Prior Publication Data

US 2010/0259169 A1 Oct. 14, 2010

(30) Foreign Application Priority Data

Jan. 26, 2006 (JP) ..... 2006-017932
Jan. 26, 2006 (JP) ..... 2006-017933
Mar. 16, 2006 (JP) ..... 2006-073472

(51) Int. Cl.
*H01J 61/36* (2006.01)

(52) U.S. Cl. ..... 313/637; 313/623; 313/627; 445/26

(58) Field of Classification Search ..... 313/627–642, 313/25, 26.3, 318.01–318.12, 567; 445/33, 445/26–28, 35, 46; 439/226
See application file for complete search history.

(56) References Cited

U.S. PATENT DOCUMENTS 6,353,289 B1 3/2002 Ishigami et al.
6,354,900 B1 3/2002 Ohshima et al.
2001/0048274 A1 12/2001 Rechermann et al.
2002/0047526 A1 4/2002 Ishigami et al.
2003/0048078 A1 3/2003 Fukuyo et al.
2005/0003729 A1 1/2005 Mizobe
2005/0200279 A1 * 9/2005 Muto et al. ..... 313/623

(Continued)

FOREIGN PATENT DOCUMENTS

EP 0 871 202 A2 10/1998

(Continued)

OTHER PUBLICATIONS

International Search Report issued by the Japanese Patent Office for International Application No. PCT/JP2007/051310.

(Continued)

*Primary Examiner* — Tracie Y Green
(74) *Attorney, Agent, or Firm* — Finnegan, Henderson, Farabow, Garrett & Dunner, L.L.P.

(57) ABSTRACT

A metal halide lamp (MHL) includes: a light-transmitting hermetic vessel made of quartz glass, including: a surrounding portion having a discharge space formed therein; and at least one sealing portion joined to the surrounding portion; electrodes sealed within the discharge space of the light-transmitting hermetic vessel; a discharge medium filled within the discharge space of the light-transmitting hermetic vessel; and at least one sealed metal foil connected to proximal ends of the electrodes and hermetically embedded within the sealing portion, the sealed metal foil being formed with height-differentiating portions comprised of laser traces on at least one of surfaces of the metal foil.

14 Claims, 9 Drawing Sheets

U.S. PATENT DOCUMENTS

| | | | | |
|---|---|---|---|---|
| 2005/0269299 | A1 | 12/2005 | Rittner | |
| 2006/0132043 | A1 * | 6/2006 | Srivastava et al. | 313/638 |
| 2011/0095683 | A1 * | 4/2011 | Yokota et al. | 313/623 |

FOREIGN PATENT DOCUMENTS

| | | | |
|---|---|---|---|
| EP | 0 883 160 | A1 | 12/1998 |
| EP | 1 160 821 | A3 | 9/2004 |
| EP | 1 492 148 | A2 | 12/2004 |
| JP | 10-112262 | | 4/1998 |
| JP | 11-238488 | | 8/1999 |
| JP | 2000-11955 | | 1/2000 |
| JP | 2001-266794 | | 9/2001 |
| JP | 2002-86283 | | 3/2002 |
| JP | 2003-86136 | | 3/2003 |
| JP | 2004-363014 | | 12/2004 |

OTHER PUBLICATIONS

Supplementary European Search Report issued by the European Patent Office on Jun. 7, 2010, for European Patent Application No. 07707542.2.

Chang et al., "Prediction of Laser-Spot-Weld Shape by Numerical Analysis and Neural Network," Metallurgical and Materials Transactions (Aug. 2001), 32B:723-731.

* cited by examiner

METAL HALIDE LAMP INCLUDING SEALED METAL FOIL

TECHNICAL FIELD

The present invention relates to a metal halide lamp having an improved sealing structure.

BACKGROUND ART

Metal halide lamps each include a light-transmitting hermetic vessel having a pair of electrodes sealed therein, a discharge medium made of light emitting metal filled within the vessel. Examples of materials to be used for constituting light-transmitting hermetic vessels include quartz glass or light-transmitting ceramics. Then, light-transmitting hermetic vessels made of quartz glass are relatively inexpensive and further have higher in-line transmittance, so that such vessels are frequently and mainly used in sources for headlights, projection lights, and the like. In case of a light-transmitting hermetic vessel made of quartz glass, sealing portions joined to a surrounding portion are formed integrally with the surrounding portion so as to seal the surrounding portion having a discharge space formed therein.

To seal the light-transmitting hermetic vessel by the sealing portions, it is typical to hermetically embed metal foils inside the sealing portions, respectively. Then, the sealed metal foils each have one end at the surrounding portion side which end carries a proximal end of an electrode welded to the end, and other end at the opposite side which end carries an external lead member welded to the end, in a manner to supply current to the electrodes through the sealed metal foils, respectively.

Further, in case of the light-transmitting hermetic vessel made of quartz glass, the sealed metal foils embedded within the sealing portions and quartz glass surrounding the metal foils establish excellent hermetic junctions therebetween throughout a period of lighting of the metal halide lamp, thereby allowing to keep the interior of the light-transmitting hermetic vessel in an intended hermetic state and to supply current to the electrodes from the external lead members through the sealed metal foils, respectively. In case of formation of the sealing portions by utilizing the sealed metal foils, it is known to apply a satin crape treatment onto both obverse and reverse surfaces of the sealed metal foils by a sand blast method, an electrochemical method, or the like so as to increase a length of an outer periphery of each sealed metal foil by virtue of the thus formed fine irregularities on the surfaces, thereby restricting leaks which otherwise occur at the sealing portions (see patent-related reference 1).

There is also known a metal halide lamp adopting sealed metal foils to form sealing portions, respectively, such that each foil is formed with a plurality of holes penetrating through the foil in its thickness direction and dispersed over the surface of the foil, in a manner that the site of the foil formed with the holes has a cross section smaller than that of a site of the foil having no holes (see patent-related reference 2). It is stated in the patent-related reference 2 that the metal halide lamp described therein is improved in close contact property at the sealing portions, so that cracks and delaminations of the sealing portions are not caused, to restrict damages of the lamp over a lifetime of the lamp.

Meanwhile, there is known a so-called mercury-free metal halide lamp (hereinafter called "mercury-free lamp", as expediency) having substantially no mercury filled therein (see patent-related reference 3). It is typical for a mercury-free lamp that the lamp includes, as a second halide sealed in the lamp, a halide of metal having a relatively high vapor pressure and insusceptible to emit light in a visible range such as zinc (Zn) halide, instead of mercury having been conventionally sealed in the lamp as a buffer substance for establishing a lamp voltage, and that a sealing pressure of rare gas for starting is set to be higher than that in case of a mercury-filling lamp in order to obtain an excellent rising-up characteristic of luminous flux.

Patent-related reference 1: Japanese Patent No. 3,150,918

Patent-related reference 2: Japanese Patent Application Laid-Open Publication No. 2001-266794

Patent-related reference 3: Japanese Patent Application Laid-Open Publication No. 11-238488

DISCLOSURE OF THE INVENTION

Problem to be Solved by the Invention

However, in case of metal halide lamps subjected to severe operating conditions such as the above-mentioned mercury-free lamps, particularly mercury-free lamps for automobile headlights where a rare gas is filled within an luminous tube at a higher pressure and/or where a relatively higher electric current is exemplarily flowed into a lamp over a relatively long time to thereby considerably raise a temperature of a sealing portion, it has been recognized that crack leaks are apt to occur even by a configuration for enhancing a close contact property between a sealing portion and a sealed metal foil such as in the patent-related reference 1 and patent-related reference 2.

Further, in case of formation of a rough surface by a sand blast method such as conducted for the metal foil to be sealed in the patent-related reference 1, it is impossible to exemplarily control a forming position of a rough surface, and a surface roughness in an intended manner such that a rough surface is formed only in an intended partial area of the foil, and such that a surface roughness of a rough surface is varied area by area. As such, it is difficult to seek for an effective surface roughness for improving a close contact property between a sealed metal foil and quartz glass by variously changing surface roughnesses, thereby bringing about such a problem that a side edge portion of a sealed metal foil which is brittle in terms of strength is susceptible to breakage when a desired rough surface is tried to be formed.

Moreover, in case of formation of rough surface by the sand blast method, blasted grinding particles are apt to attach to a metal foil to be sealed and are to be left there, so that the grinding particles act as impurities, which tend to obstruct formation of electroconductive connections between an electrode and/or external lead member and the metal foil to be sealed, and to obstruct close contact properties therebetween. When it is intended to remove the grinding particles attached to the metal foil to be sealed, there is required a post treatment, thereby not only requiring a burden but also causing a difficulty in sufficient removal.

In turn, in case of the patent-related reference 2 in contrast to the above, it has been recognized that cracks (foil tearing) are caused between an end of a foil and a hole near the end during a sealing process of sealing portions, thereby bringing about a problem that fine cracks are apt to be caused.

As a result that the present inventors have earnestly investigated crack leaks apt to be caused in the related art, the reason thereof has been recognized to be a fact that halides in a discharge medium become apt to migrate in a direction of the sealing portion.

Thus, the present inventors have conducted extensive endeavors so as to solve the problems, and have eventually found out that: formation of height differences by means of laser process at surfaces of a metal foil to be sealed will lead to an excellent close contact property between the metal foil to be sealed and quartz glass; and the height differences exhibits a function to prevent or restrict migration of halides. The present invention has been carried out, based on such a knowledge.

The present inventors have further found out that the problem can be more effectively solved by adopting height differences in predetermined configurations, even in case of a metal halide lamp to be subjected to a severe operating condition such as a mercury-free lamp for an automobile headlight.

It is therefore an object of present invention to provide a metal halide lamp including sealed metal foils embedded within sealing portions, each metal foil having surfaces formed with height differences thereon, thereby restricting occurrence of crack leaks in the sealing portions.

Means for Solving the Problem

The present invention provides: a metal halide lamp comprising:

a light-transmitting hermetic vessel made of quartz glass, including: a surrounding portion having a discharge space formed therein; and at least one sealing portion joined to the surrounding portion;

electrodes sealed within the discharge space of the light-transmitting hermetic vessel;

a discharge medium filled within the discharge space of the light-transmitting hermetic vessel, and containing at least a halide of light emitting metal and a rare gas; and at least one sealed metal foil connected to proximal ends of the electrodes and hermetically embedded within the or each sealing portion of the light-transmitting hermetic vessel, the or each sealed metal foil being formed with height-differentiating portions on at least one of surfaces of the or each metal foil by means of laser process.

Effect of the Invention

According to the present invention, the surface of the sealed metal foil is formed with height-differentiating portions by laser process, thereby enabling provision of a metal halide lamp, which lamp is excellent in close contact property between the sealed metal foil and quartz glass of the associated sealing portion, and which lamp is configured to prevent or restrict migration of halides to thereby restrict occurrence of crack leaks.

Further, according to the present invention, the height-differentiating portions are formed by laser process, so that such formation can be controlled for a desired area of the metal foil to be sealed, in a desired configuration and in a desired manner.

Moreover, insofar as depths, widths, and the like of the height-differentiating portions of the sealed metal foils are kept within predetermined ranges, there can be attained a further improved close contact property between the sealed metal foils and quartz glass, and a further prevented or restricted migration of halides.

Furthermore, insofar as the height-differentiating portions are formed on the sealed metal foil at least near the site where the proximal end of the associated electrode is connected to the sealed metal foil, it becomes possible to effectively prevent or restrict migration of discharge medium from the proximal end of the electrode toward the periphery of the sealed metal foil.

Further, insofar as the height-differentiating portions are formed of multiple grooved portions extending in the tube axis direction, respectively, it becomes possible to further effectively prevent migration of halides from the proximal end of the electrode toward the side edges of the sealed metal foil.

EXPLANATIONS OF LETTERS OR NUMERALS

Figure 1:
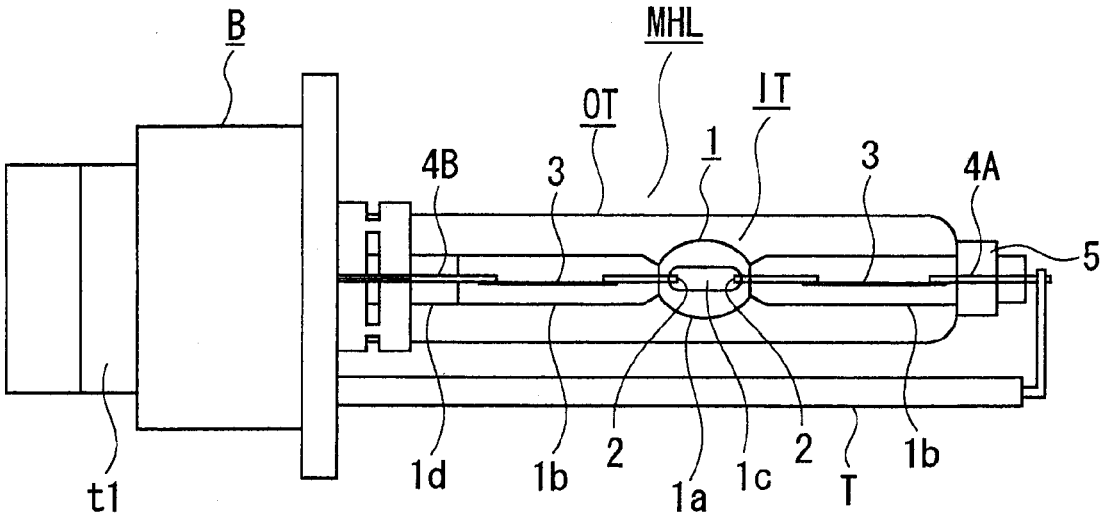
FIG. 1 is a side view of a metal halide lamp for an automobile headlight as a first mode for implementing a metal halide lamp of the present invention.

1 . . . light-transmitting hermetic vessel
1*a* . . . surrounding portion
1*b* . . . sealing portion
1*c* . . . internal space
2 . . . electrode
3 . . . sealed metal foil
4A, 4B . . . external lead member
5 . . . decreased diameter portion
G . . . grooved portion
G' . . . pitted portion
IT . . . luminous tube
MHL . . . metal halide lamp
OT . . . outer tube

BEST MODE FOR CARRYING OUT THE INVENTION

Modes for carrying out the present invention will be described hereinafter with reference to the drawings.

FIG. 1 through FIG. 6 show a metal halide lamp for an automobile headlight, as a first mode for implementing a metal halide lamp of the present invention.

The metal halide lamp of the present invention comprises, at least, a light-transmitting hermetic vessel 1, electrodes 2, a discharge medium, and sealed metal foils 3.

In this mode, the metal halide lamp MHL further comprises an luminous tube IT, an insulating tube T, an outer tube OT, and a base B, in addition to the above components.

(Re: Illumination Tube IT) The luminous tube IT comprises the light-transmitting hermetic vessel 1, the electrodes 2, the sealed metal foils 3, external lead members 4A and 4B, and the discharge medium. Note that since the luminous tube IT includes all the above-mentioned components of the present invention, it is possible in the present invention to eliminate the constituent members such as the outer tube OT, as desired.

(Re: Light-Transmitting Hermetic Vessel 1) The light-transmitting hermetic vessel 1 is made of quartz glass and thus has a light-transmitting ability and a fire resistance, and comprises a surrounding portion 1*a* having a discharge space 1*c* formed therein, and sealing portions 1*b* joined to the surrounding portion 1*a*. The surrounding portion 1*a* is hollow to define a hollow space as the discharge space 1*c*. The discharge space 1*c* has an inner volume which can be appropriately set depending on the application of the metal, halide lamp, and the inner volume is typically 0.1 cc or less for a small-sized metal halide lamp preferable for application of the present invention. Further, in case of a metal halide lamp for a headlight, the inner volume is preferably 0.05 cc or less.

The discharge space 1*c* may be formed into an arbitrary shape, such as substantially cylindrical, spherical, or oval spherical shapes. In case of a metal halide lamp for an automobile headlight, it is preferably in a substantially cylindrical shape. Contrary, the surrounding portion 1*a* of the light-transmitting hermetic vessel 1 has an outer surface exhibiting a rotated quadric surface shape, such as an oval spherical shape or a spindle shape. As such, the surrounding portion 1*a* has a wall thickness which is typically the largest at the central portion in the tube axis direction and successively decreased toward both end directions.

Further, the surrounding portion 1*a* and the discharge space 1*c* defined therein in the light-transmitting hermetic vessel 1 as a metal halide lamp for an automobile headlight, have desirable sizes as follows. Namely, the surrounding portion 1*a* has a length of 7.4 to 8.2 mm in the tube axis direction, the discharge space 1*c* has an inner diameter of 2.2 to 2.9 mm, an outer diameter of 5.6 to 6.9 mm, and a wall thickness of 1.5 to 2.5 mm, and the discharge space 1*c* has an inner volume of 20 to 35 μl.

Furthermore, the phrase that the light-transmitting hermetic vessel 1 "has a light-transmitting ability and a fire resistance", means that the vessel has a light-transmitting ability at least at a light guiding portion acting as a site for deriving emitted light to the exterior of the surrounding portion 1*a*, and that the vessel has a heat resistance at least at a level capable of sufficiently withstanding a normal operation temperature of the metal halide lamp MHL. Note that it is allowed to form a transparent coating having a resistance to halogen or halide onto an inner surface of the surrounding portion 1*a* of the light-transmitting hermetic vessel 1, or to modify an inner surface of the light-transmitting hermetic vessel 1, as required.

The sealing portions 1*b* are joined to the surrounding portion 1*a* and formed integrally with the surrounding portion 1*a*. Note that the sealing portions 1*b* may be formed by joining them to both ends of the surrounding portion 1*a* by means of glass-welding, respectively, or may be formed monolithically with the surrounding portion 1*a*.

In this mode, the pair of sealing portions 1*b* are allowed to be formed to extend in the tube axis direction of the surrounding portion 1*a* from its both ends, respectively. However, the sealing portions may be provided in such a structure that they are joined to only one end of the surrounding portion 1*a* as desired.

Further, the sealing portions 1*b* are configured to seal the surrounding portion 1*a*, and have, embedded therein, proximal ends of the electrodes 2 to be described later, respectively. To realize it, the sealing portions 1*b* have, embedded therein, sealed metal foils 3 to be described later. Further, the pair of sealing portions 1*b*, 1*b* extend in the tube axis direction from both ends of the surrounding portion 1*a* integrally therewith, and substantially linearly, respectively.

(Re: Electrode 2) The electrodes 2 have main portions at tip end sides sealedly located at predetermined positions within the surrounding portion 1*a* of the light-transmitting hermetic vessel 1, respectively. As such, the electrodes 2 have intermediate portions supported by the associated sealing portions 1*b*, respectively, and proximal ends connected to the sealed metal foils 3 to be described later, respectively, such as by welding.

In this mode, the pair of electrodes 1*b*, 1*b* are sealed within the surrounding portion 1*a*, in a separated and opposed manner. Further, when the pair of sealing portions 1*b*, 1*b* are to be provided, two electrodes 2 are supported by the sealing portions 1*b* one by one, as described above. Contrary, in case of providing a single sealing portion 1*b* and a pair of electrodes 2, 2, the pair of electrodes 2, 2 are to be supported by the sealing portion 1*b* in a mutually separated manner.

The electrodes 2 each have a stem portion of a diameter which is desirably set at an appropriate value typically within a range of 0.25 to 0.45 mm, in case of a small-sized metal halide lamp.

Further, the electrodes 2 in this mode may be made of a refractory metal selected from a group such as consisting of tungsten (W), doped tungsten, thorium tungsten, rhenium (Re), and tungsten-rhenium (W—Re) alloy.

The electrodes 2 may each have a tip end portion having a diameter larger than that of its stem portion, such as cylindrical, or substantially spherical. In that case, the stem portion desirably has a diameter of 0.25 to 0.30 mm and the tip end portion desirably has a diameter of 0.30 to 0.40 mm.

Note that the stem portion of each electrode 2 supported within the sealing portion 1*b* may be configured to have a coil such as made of tungsten, wound on the electrode. Typically, in case that a coil is wound on a stem portion of an electrode, this is effective against cracks to be caused in quartz glass due to interaction between the electrode stem portion and the quartz glass, but crack leaks become apt to be caused in a sealed metal foil because the coil rather tends to form entrance paths of halogen. Nonetheless, applying the present invention allows for restriction of crack leaks in a sealed metal foil even when a coil is wound on an electrode.

Further, in case of providing a pair of electrodes 2, 2, the electrodes may be formed in the same configuration in a known manner suitable for lighting the high pressure discharge metal halide lamp MHL by an alternating current. However, it is also possible to form one electrode 2 into an anode having a larger heat capacity and the other electrode 2 into a cathode having a smaller heat capacity, thereby establishing a configuration suitable for lighting by direct current.

(Re: Sealed Metal Foil 3) The sealed metal foils 3 are hermetically embedded within the sealing portions 1*b*, respectively. Further, so as to supply current to the electrodes 2 from an operating circuit (not shown), desirably an electronized operating circuit, the proximal ends of the electrodes 2 are connected to one ends of the sealed metal foils 3 at the surrounding portion 1*a* side, respectively, and the external lead members 4A and 4B to be described later are connected to the other ends of the foils, respectively, as desired. Note that although the wall thickness of each sealed metal foil 3 is not particularly limited in the present invention, it is typically 50 μm or less.

Figure 2:
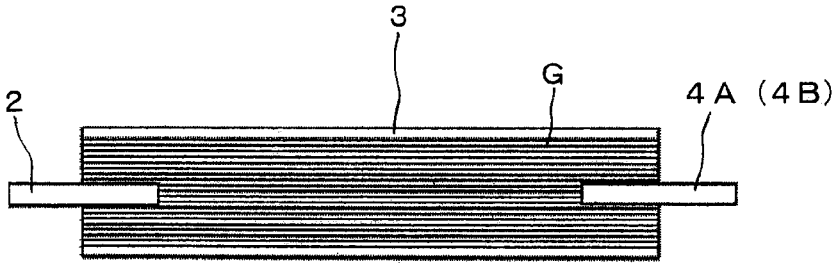
FIG. 2 is an enlarged front view of a sealed metal foil portion of the metal halide lamp.
Figure 3:
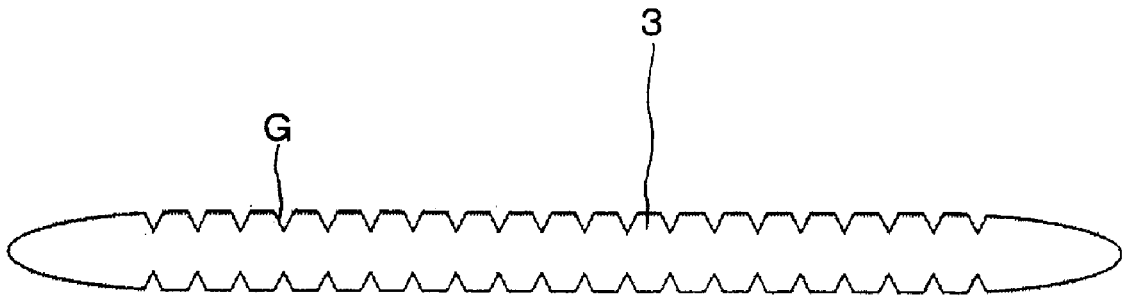
FIG. 3 is an enlarged cross-sectional view of the sealed metal foil.

In the present invention, each sealed metal foil 3 is the most characteristic constituent part, and has a surface formed with height-differentiating portions as a first configuration by means of laser process. Height-differentiating portions can be formed by grooved portions G in concaved recess shapes such as shown in FIG. 2 and FIG. 3, or pitted portions G'. Namely, the sealed metal foils 3 each have a surface exhibiting height differences. Here, each grooved portion G is a set of pitted portions G' in spot shapes, each of which is to be obtained by irradiation of laser one time. The pitted portions G' can be controlled in terms of cross-sectional shapes, dimensions, and the like for concaved recess shapes, by means of laser focusing manner, control of input, and the like. For example, it is possible to obtain cross-sectional shapes as exemplarily shown in FIG. 4(*a*) and FIG. 4(*b*), having fundamental shapes of inverted triangle and inverted trapezoid, respectively.

Figure 5:
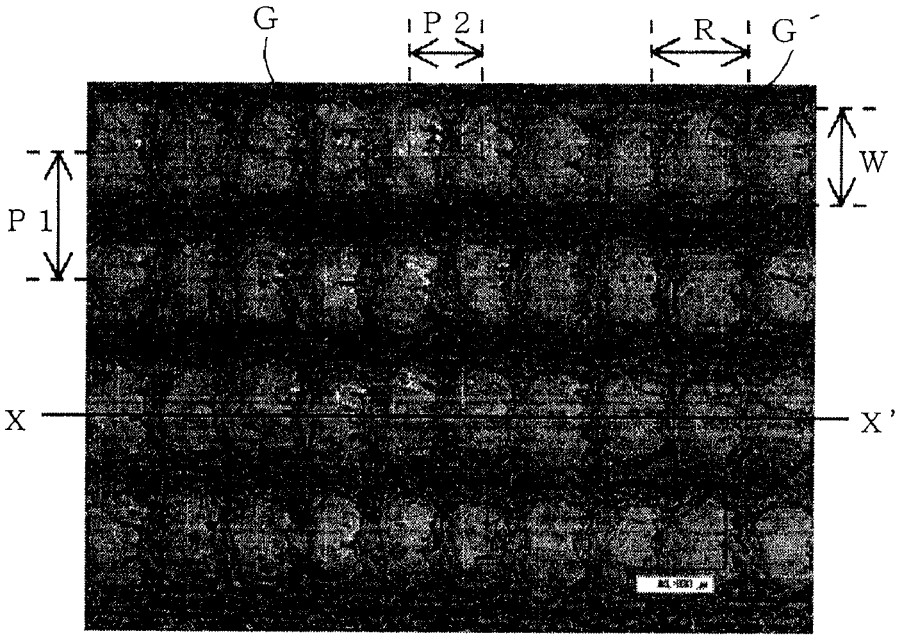
FIG. 5 is a microphotograph of a surface of the sealed metal foil, enlargingly showing grooved portions formed on the surface of the sealed metal foil.

Here, when grooved portions G formed on a foil are viewed by a microscope, it is recognized that each grooved portion G is constituted of pitted portions G' joined to one another as shown in FIG. 5. Such a shape can be formed by successively irradiating laser, in a manner to overlap the irradiation area with a part of previously formed pitted portion G'. Note that, as seen from this figure, since irradiation of laser onto a surface of a metal foil 3 to be sealed, leaves laser traces which are meltedly formed into characteristic spot shapes, respectively, it can be easily judged whether or not height-differentiating portions on the surface have been formed by laser process.

Here, the height-differentiating portions can be provided at desired values of: depths, by varying electric current values upon generating laser spots; widths, by varying a diameter of each laser spot irradiated from a laser irradiating apparatus; and pitches between adjacent grooved portions G and between pitted portions G', by varying irradiating positions of laser spots, respectively.

The height-differentiating portions will be explained for depths thereof, as follows. Namely, the depth of a height-differentiating portion is a dimension between a top portion and a bottom portion of the height-differentiating portion in a foil thickness direction, within a cross section of the height-differentiating portion. Thus, when the height-differentiating portion is a concave portion formed on a foil surface, the depth of the concave portion is the depth of the height-differentiating portion. Further, when the height-differentiating portion is a convex portion formed on a foil surface, the depth of the height-differentiating portion is a dimension, i.e., height of the height-differentiating portion between the top portion thereof and the foil surface in the foil thickness direction. Moreover, when the height-differentiating portion is formed of a concave portion concavedly recessed from a foil surface and a convex portion protruded from the foil surface, this is a state where the concave portion and the convex portion are neighbored to each other with respect to the foil surface, and the depth of the height-differentiating portions in this configuration is a sum of the depth of the concave portion and the height of the convex portion.

Further, those regions of a metal foil 3 to be sealed are as follows, which regions are provided with height-differentiating portions formed by means of laser process.

The first configuration is substantially the whole areas of both surfaces of a sealed metal foil 3. This configuration is preferable, since the closest contact property can be obtained then. Only, it is possible to refrain from forming height-differentiating portions up to a partial area of a sealed metal foil 3 such as a side edge(s) thereof, as desired.

The second configuration is to form height-differentiating portions only near a portion of a sealed metal foil 3 connected to an associated electrode 2. There can be thus obtained intended functions and effects of the present invention, since this configuration also tends to prevent occurrence of such a phenomenon that halides diffuse, i.e., migrate radially from a proximal end of an electrode 2 and along a surface of a sealed metal foil 3 therearound to thereby break the sealing between the sealed metal foil 3 and quartz glass. Note that the above-described term "near" is a concept embracing: a connected position itself of the electrode 2 to the sealed metal foil 3; a position slightly advanced toward a central portion side of the sealed metal foil 3 from the connected position; and positions separated from the connected position toward both side portions of the sealed metal foil 3, respectively. In case of a metal halide lamp for an automobile headlight, those which can be regarded as being "near" the connecting portion of the proximal end of the electrode 2 are: a position, from that end of a sealed metal foil 3 which is connected to a proximal end side of the electrode 2, up to a distance of 3 mm toward the other end of the sealed metal foil 3 in the tube axis direction; and a position, from a tip end of the proximal end of an electrode 2, up to a distance of 1 mm toward the other end of the sealed metal foil 3.

Next, there will be explained configurations of height-differentiating portions to be formed by means of laser process.

The first configuration is shown in FIG. 2. Namely, the sealed metal foil 3 has both surfaces each formed with a plurality of grooves extending in the tube axis direction, except for side edge portions. This first configuration is most effective. According to this configuration, there can be favorably obtained both effects of: improvement of close contact property between the sealed metal foil 3 and glass; and restriction of diffusion of halides toward side edge portions of the sealed metal foil 3.

FIG. 3 enlargingly shows the cross-sectional shape of the sealed metal foil 3 shown in FIG. 2. The sealed metal foil 3 is formed into a knife edge shape having a thickness gradually decreasing toward side edge portions, respectively, so as to enhance a close contact property between the foil and glass. In case of forming height-differentiating portions on the sealed metal foil 3 in such a shape, it is desirable to conduct formation up to such positions that the side edge portions are not penetrated nor broken.

The remaining portions of the surfaces of the sealed metal foil 3, where height-differentiating portions are not formed, may be constituted as flat surfaces, respectively. However, such remaining portions of the foil surfaces may be roughened, as desired. For example, it is possible to form height-differentiating portions after forming a foil surface into a rough surface such as by means of sand blast. Note that, although the term "rough surface" means a state of a surface where irregularities having depths of 0.8 μm or less, preferably 0.4 μm or less are numerously formed on the surface as seen in the related art, the rough surface herein is supposed to be set at an apparently small value which is equal to or less than a half of a height difference to be provided by laser process, in a manner that the surface roughness can be distinguished from the height difference.

In the present invention, when grooved portions G extending in an axial direction of an electrode 2 are to be formed, the grooved portions G are to desirably extend in a manner parallel to the axial direction of the electrode 2 and in a linearly elongated manner. However, the present invention is not limited thereto, and grooved portions may be provided in various shapes such as angled, curved, or meshed ones to be described later, as desired.

Further, since the length of and the number of grooved portions G to be formed on a surface of a metal foil 3 to be sealed, are not particularly limited, it is enough: to simply form several grooved portions G on that surface of the metal foil which surface is connected with a proximal end of an electrode 2, at both sides of the proximal end, respectively, as desired; or to form totally two grooved portions G at such both sides, respectively, as the case may be.

The second configuration is to form a plurality of pitted portions G' in a dispersed dot manner.

The third configuration is to form pitted portions G' in an intimate manner without overlapping.

Note that the second and third configurations will be explained later.

Next, the effect of the present invention is further enhanced, in a manner that height differences provided by laser process are configured to fall within the following predetermined ranges. This will be explained hereinafter.

In the first predetermined ranges, surface roughnesses of height-differentiating portions are defined by surface roughnesses Ra and Rz standardized in JIS B0601, as follows.

There will be firstly explained a preferable range of a surface roughness Ra. The surface roughness Ra (μm) of height-differentiating portions G formed by laser process is to be within a range satisfying a formula: $0.4 \leqq Ra$. Note that the reason why the formula has not an upper limit is as follows. Namely, in the present invention, larger values of surface roughness Ra are more effective, and while it is possible to achieve fairly large Ra's insofar as by means of laser process, it is rather preferable to achieve a range satisfying a formula: $0.4 \leqq Ra$ so as to keep a strength of a sealed metal foil.

There will be further explained a surface roughness Rz. The surface roughness Rz (μm) is to be within a range satisfying a formula: $1.0 \leqq Rz \leqq 7.0$. Namely, height-differentiating portions are required to refrain from penetrating a sealed metal foil 3 in its wall thickness direction, because depths of height-differentiating portions exceeding the wall thickness will form holes to obstruct a function of the sealed metal foil 3. Further, height differences are desirably about half of the wall thickness, as a rough standard for sufficiently exploiting the function of the sealed metal foil 3.

Exemplarily explaining with reference to FIG. 5, the second predetermined ranges are such that preferable depth D, width W, and pitch P1 are within the following ranges, whether or not height-differentiating portions constitute grooved portions G. Values in these ranges are measured by microphotographs.

Preferable depths D of height-differentiating portions are 1 μm or more. However, such depths are preferably about 2 μm. Note that although an upper limit is not given to a depth D of height-differentiating portions, it is not allowed to penetrate a foil. In the present invention, larger values of depths D are more effective. However, the sealed metal foil 3 is subjected to a limitation of its wall thickness, so that values of depths penetrating the foil are not allowed because the function of the sealed metal foil 3 is obstructed then as described above. Further, as a rough standard to sufficiently exploit the function of the sealed metal foil 3, depths of height-differentiating portions are desirably about half of the wall thickness. In consideration of these circumstances, there will naturally exist an upper limit of depth D.

Figure 4:
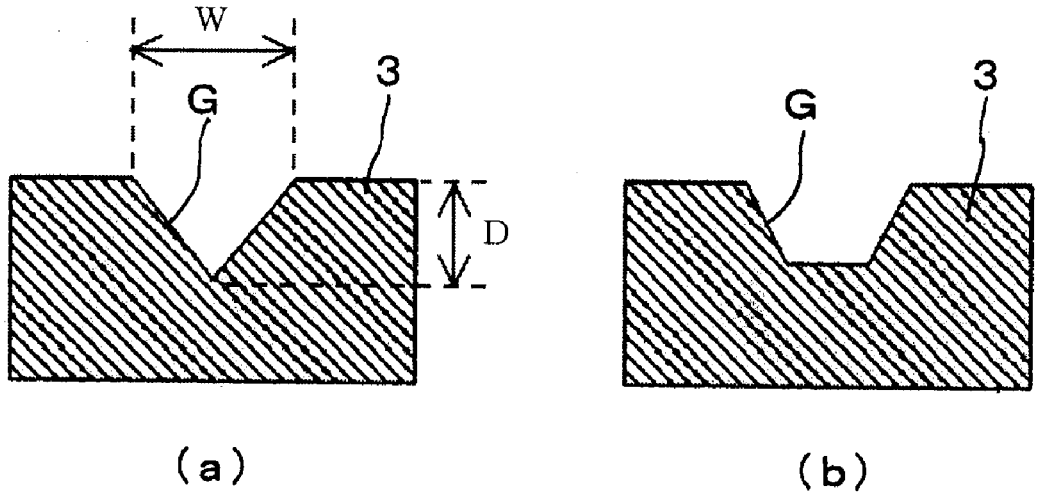
FIG. 4 is a schematically enlarged cross-sectional view of two kinds of cross-sectional shapes of height differences in the sealed metal foil, provided by pitted portions formed by laser process.

There will be explained a width W of height-differentiating portions, with reference to FIG. 4 and FIG. 5. Namely, the width W is preferably 100 μm or less. More preferably, it is 50 μm or less.

There will be further explained a pitch P1 between adjacent height-differentiating portions, with reference to FIG. 5. Namely, the preferable pitch P1 is 200 μm or less, in case that height-differentiating portions exhibit juxtaposed grooves. More preferably, it is 100 μm or less. Note that P1 means a distance between centers of a pair of adjacent height-differentiating portions.

There will be next explained a situation that height-differentiating portions are constituted of grooved portions G formed by continuous shots of laser spots. The spot pitch P2 among adjacent laser spots continuously provided in the tube axis direction is desirably within a range satisfying a formula: $R/2 \leqq P2 < R$, where R is a diameter of each laser spot. The reason thereof is as follows.

Figure 6:
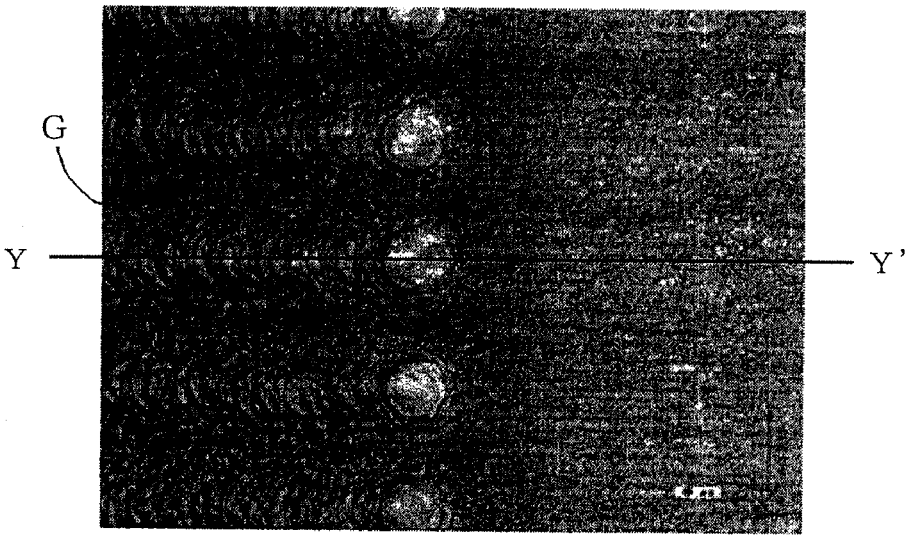
FIG. 6 is a microphotograph of a surface of the sealed metal foil, enlargingly showing grooved portions provided by spot pitches P2 less than R/2.
Figure 7:
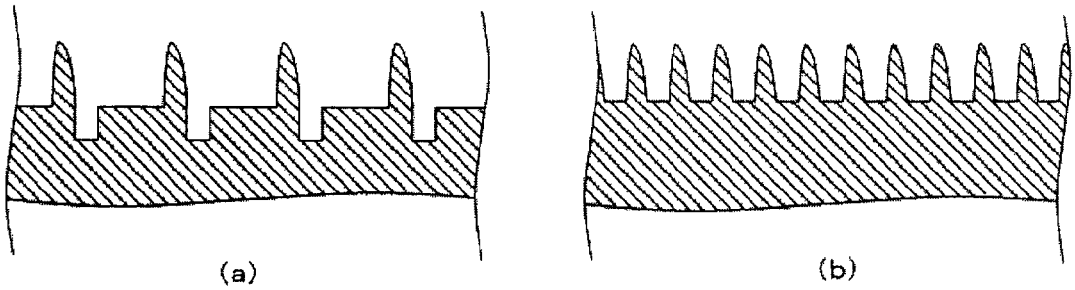
FIG. 7(*a*) is a schematic cross-sectional view of the grooved portion shown in FIG. 5, and FIG. 7(*b*) is schematic cross-sectional view of the grooved portion shown in FIG. 6.

Namely, when the spot pitch P2 is less than R/2, height-differentiating portions fail to visually simulate grooves and to provide a function as grooves, as exemplified in FIG. 6 (spot pitch P2=R/6). In this case, grooves formed by laser process bring about crater rims, i.e., ridged portions around laser spots, respectively, due to influence of the laser process, and these crater rims have heights which are close to a height of a reference surface of a foil in an unprocessed state. As such, crater rims are excessively neighbored to one another in the tube axis direction to thereby deteriorate the function as grooved portions G, as exemplified in FIG. 7(*b*) showing a schematic cross-sectional view of grooved portions G of FIG. 6. Note that FIG. 7(*b*) enlargingly shows the schematic cross-sectional view of grooves along a Y-Y' line in FIG. 6.

On the other hand, spot pitches P2 larger than diameters R of laser spots result in grooves which are each divided at laser spot by laser spot, thereby failing to form grooved portions G each having a shape of groove continuously elongated in the axial direction.

Contrary, spot pitches P2 within a range satisfying the formula: R/2≦P2<R allow for obtainment of grooved portions G in the desired groove shapes, as exemplified in the schematic cross-sectional view of FIG. 7(*a*) for the grooved portion in FIG. 5.

There will be next explained a material of a sealed metal foil 3. Although the material of the sealed metal foil 3 is not particularly limited, it is possible to adopt molybdenum (Mo), or rhenium-tungsten alloy (Re—W), for example.

Although the method for embedding a sealed metal foil 3 within a sealing portion 1*b* is not particularly limited, it is possible to adopt a shrink seal method, pinch seal method, solely or combinedly. The latter is preferable, in case of a metal halide lamp such as used for a headlight where the surrounding portion 1*a* is small-sized having an inner volume of 0.1 cc or less, and the inner volume is sealedly filled with rare gas such as xenon (Xe) at a pressure of 5 atm or higher at a room temperature.

Incidentally, FIG. 1 shows a sealing tube 1*d* which is left without being cut out even after forming the left side sealing portion 1*b* and which is extended from and integrally with an outer end of the sealing portion 1*b*, into a base B to be described later.

(Re: External Lead Members 4A and 4B) In this mode, the external lead members 4A and 4B have: distal ends welded to other ends of sealed metal foils 3 within sealing portions 1*b* at both ends of the light-transmitting hermetic vessel 1, respectively; and proximal ends drawn out to the exterior. In FIG. 1, the external lead member 4A rightwardly drawn out from the luminous tube IT has an intermediate portion folded back along the outer tube OT to be described later, so that the external lead member is introduced into the base B to be described later and is connected to one base terminal t1 in a manner not shown. In FIG. 1, the external lead member 4B leftwardly drawn out from the luminous tube IT extends along the tube axis within the sealing tube 1*d* and is introduced into the base B and connected to the other base terminal (not shown).

(Re: Discharge Medium) The discharge medium includes at least metal halides and rare gas, while mercury may be or may not be contained. However, since the sealed metal foils according to the present invention are each provided with height differences in a manner to provide a remarkably excellent close contact property between the metal foil and quartz glass of the associated sealing portion 1*b* and to effectively restrict migration of halide toward a peripheral portion of the sealed metal foil, there can be obtained a metal halide lamp capable of effectively restricting crack leaks to achieve an excellent lifetime characteristic, even as a mercury-free lamp. Insofar as desirable as a mercury-free lamp, the metal halide lamp is of course suitable, without any problems, as a mercury-filling lamp to be subjected to an internal pressure and a temperature of sealed metal foils lower than those of a mercury-free lamp.

The metal halides are halides of metals including at least light emitting metal. However, concrete metal halides are not particularly limited. For example, the preferable configuration of a mercury-free lamp for a headlight includes halides of a plurality of metals selected from a group consisting of scandium (Sc), sodium (Na), indium (In), zinc (Zn), and rare earth metals. In this configuration, the discharge medium is allowed to supplementarily contain metal halides other than the above group, in addition to the formulation consisting of metal halides belonging to the above group. For example, addition of halide of thallium (Tl) as a main light emitting substance allows for a further enhanced light emitting efficiency.

In the above configuration, halide of zinc (Zn) has a relatively high vapor pressure and provides less emission in a visible range, and thus mainly contributes to establishment of lamp voltage. However, as metal halides for establishing a lamp voltage, it is possible to use ones comprising the following group instead of or in addition to zinc, because such metal halides exhibit functions and effects substantially the same as those of zinc as desired. Namely, it is possible to raise a lamp voltage to a desired value, by filling, into the lamp, halides of one or more kinds of metals selected from a group consisting of magnesium (Mg), cobalt (Co), chromium (Cr), manganese (Mn), antimony (Sb), rhenium (Re), gallium (Ga), tin (Sn), iron (Fe), aluminum (Al), titanium (Ti), zirconium (Zr), hafnium (Hf), and indium (In). Although the halides of the metals of the group all have higher vapor pressures and do not emit light within a visible range, or do emit light in a relatively small amount so that the metals are not expected as ones for operatively gaining luminous flux, halides of these metals are each suitable for mainly establishing a lamp voltage.

Rare gas acts as a starting gas and buffer gas, and it is possible to use one or more kinds of rare gases such as argon (Ar), krypton (Kr), and xenon (Xe). Further, in order to hasten rising-up of luminous flux and to emit white light from immediately after starting as a metal halide lamp MHL for an automobile headlight, xenon is to be preferably filled within the lamp at a pressure in a range of 7 to 18 atm, more preferably 8 to 13 atm, or in a manner to establish a pressure of 50 atm or higher for the internal space upon lighting. This allows for contribution of white light emission of Xe as luminous flux upon rising-up, when the vapor pressure of light emitting metal is low just after starting.

(Re: Mercury) In the present invention, free selection is allowed for filling of mercury. The configuration as a mercury-free lamp is substantially free of mercury. However, in this configuration, although mercury (Hg) is not filled at all, there is allowed existence of mercury less than 2 mg, preferably 1 mg or less, per 1 cc of inner volume of the light-transmitting hermetic vessel 1.

Nonetheless, it is desirable to fully exclude filling of mercury, from an environmental standpoint. However, the above allowed value can be regarded as being substantially and remarkably less amounts of mercury, as compared with the conventional situation where 20 to 40 mg, and 50 mg or more as the case may be, of mercury was filled within a metal halide lamp per 1 $cm^3$ of an inner volume of a hermetic vessel in a short arc type so as to desirably raise a lamp voltage of the lamp by means of mercury vapor.

(Re: Kind of Halogen) As kinds of halogen constituting halides, iodine is optimum in terms of reactivity among halogens, and the main light emitting metal is filled as iodide. However, it is possible to combiningly use compounds of different halogens, such as iodide and bromide, if required.

(Re: Insulating Tube T) The insulating tube T is made of ceramic, and the insulating tube T encloses the external lead wire 4A.

(Re: Outer Tube OT) In the present invention, the metal halide lamp MHL is allowed to comprise the outer tube OT, as desired. The outer tube OT is made of quartz glass, high silicate glass or the like, and acts as means for housing therein at least a main portion of the luminous tube IT. Further, the outer tube is exemplarily constituted to: cut off ultraviolet rays radiated from the luminous tube IT toward the exterior; mechanically protect the luminous tube; prevent occurrence of transparency loss of the luminous tube to be caused by adherence of fingerprint, grease, and the like of a hand of a user upon contact with the light-transmitting hermetic vessel 1 of the luminous tube IT; and thermally insulate the light-transmitting hermetic vessel 1.

Further, the interior of the outer tube OT may be hermetically sealed relative to an outside air depending on the purpose, or may fill inert gas therein. In this mode, nitrogen is filled at 0.1 atm.

Furthermore, the outer tube OT may be provided with a light-shielding film at its outer surface or inner surface.

In the configuration shown in the figure, the outer tube OT can be constituted to be supported by the light-transmitting hermetic vessel 1, by glass-welding both ends of the outer tube to the sealing portions extended in the tube axis direction from both ends of the light-transmitting hermetic vessel 1, respectively, upon formation of the outer tube OT. The outer tube OT has an ultraviolet light cutting capability in a manner to house the luminous tube IT therein, and has the decreased diameter portion 5 glass-welded to the sealing portion 1*b* of the luminous tube IT. Only, the interior of the outer tube is not airtight, and communicated to the outside air.

(Re: Base B) In the present invention, the metal halide lamp MHL is allowed to comprise the base B, as desired. The base B acts as means for exemplarily connecting the metal halide lamp MHL to an operating circuit (not shown) and mechanically support the lamp, and in the configuration as shown, the base is standardized for an automobile headlight in a manner to plantedly support the luminous tube IT and outer tube OT along the central axis of the base, and the base is configured to be detachably mounted onto a backside of the automobile headlight.

Embodiment 1

The embodiment 1 includes the sealed metal foils 3 each having the configuration shown in FIG. 3 and FIG. 5, such that the height-differentiating portions G at the foil surfaces are set as follows.

Ra=0.8 (μm), and Rz=2.7 (μm)

Note that the embodiment has adopted YAG laser at 18 A and a spot diameter of 30 μm, for laser process.

Next, concerning metal halide lamps for an automobile headlight fabricated by adopting metal foils 3 to be sealed with various surface roughnesses Ra, there will be explained test results of leak occurrence rate and leak occurrence time in an EU rated mode lighting, with reference to Table 1 and FIG. 5. Note that the metal halide lamps subjected to the test were mercury-free ones, and had main specifications as follows. Diameter of proximal end of electrode: 0.3 mm; a distance between the pair of electrodes: 4.2 mm; and length of 7.0 mm, width of 1.5 mm, and thickness of 20 μm for sealed metal foil. Further, each surface roughness Ra was obtained by measurement within an area of 50 $\mu m^2$ of a surface of each metal foil 3 to be sealed.

TABLE 1

| | Ra (μm) | | | | | | | | | | | | |
|---|---|---|---|---|---|---|---|---|---|---|---|---|---|
| | 0.2 | 0.3 | 0.4 | 0.5 | 0.7 | 0.8 | 1.0 | 1.5 | 1.7 | 2.0 | 2.2 | 2.5 | 3.0 |
| Leak occurrence rate (%) | 30 | 20 | 0 | 0 | 0 | 0 | 0 | 0 | 0 | 0 | 0 | 0 | 0 |

As seen from Table 1, surface roughnesses Ra of 0.4 μm or higher allows for obtainment of metal halide lamps which are free of leaks insofar as in the EU rated mode.

Figure 8:
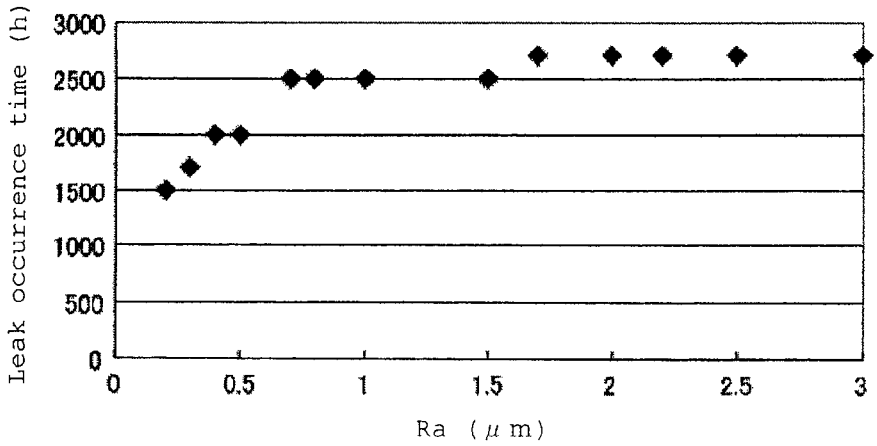
FIG. 8 is a graph of a relationship between a surface roughness Ra at height-differentiating portions and a leak occurrence time.

FIG. 8 is a graph showing a lighting time where crack leaks are caused in any one of twelve metal halide lamps belonging to each kind of metal halide lamp listed in Table 1 upon conducting the test in the EU mode, and it is seen that leaks are not caused until 2,000 hours in the above mode when surface roughnesses Ra are 0.4 μm or more. Further, Ra's of 0.7 μm or more and Ra's of 1.7 μm or more allow for obtainment of metal halide lamps which are free of occurrence of leaks until 2,500 hours and 2,700 hours, respectively.

Embodiment 2

The embodiment 2 includes the sealed metal foils 3 each having the configuration shown in FIG. 3 and FIG. 5, such that the foil surfaces having height-differentiating portions comprising grooved portions G are set as follows. Dimensions of the height-differentiating portions are as follows.

Depth D: 2 μm, width W: 30 μm, and pitch P1: 50 μm.

Further, concerning metal halide lamps fabricated by adopting metal foils 3 to be sealed with various depths D, widths W, and pitches P1 of grooved portions G, there will be explained test results of leak occurrence rate and leak occurrence time in the EU rated mode lighting, with reference to Table 2, Table 3, FIG. 9, and FIG. 10. Note that the metal halide lamps subjected to the test were mercury-free ones, and had the same main specifications as embodiment 1. Further, data were obtained in the same manner as embodiment 1.

TABLE 2

| | Depth D (μm) | | | | |
|---|---|---|---|---|---|
| | 0.2 | 0.5 | 1.0 | 2.0 | 3.0 |
| Leak occurrence rate (%) | 50 | 40 | 0 | 0 | 0 |

As seen from Table 2, depths D of 1 μm or higher of height-differentiating portions allow for obtainment of metal halide lamps which are free of leaks until 2,000 hours insofar as in the EU rated mode.

Figure 9:
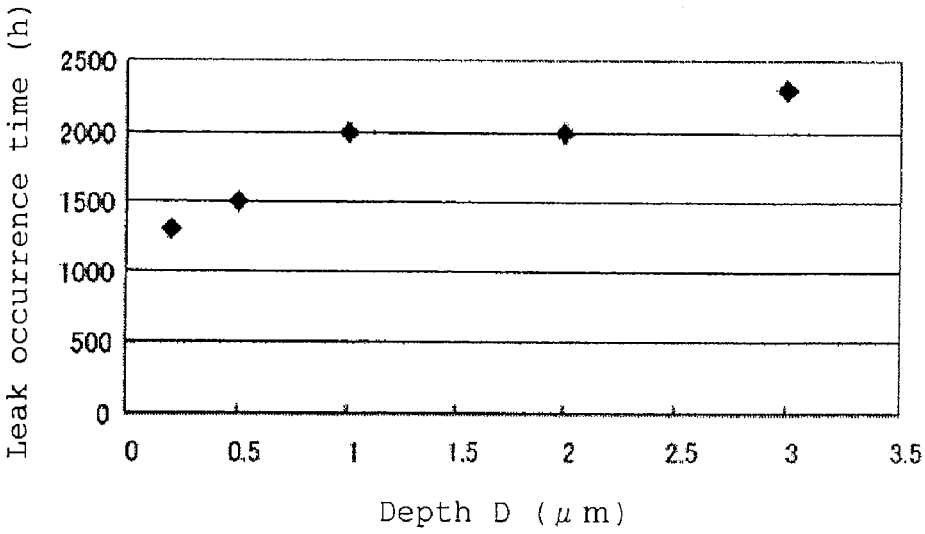
FIG. 9 is a graph of a relationship between a height difference D at height-differentiating portions and a leak occurrence time.

FIG. 9 is a graph showing a lighting time where crack leaks are caused in any one of twelve metal halide lamps belonging to each kind of metal halide lamp listed in Table 2 upon conducting the test in the EU mode, and it is seen from FIG. 9 that depths D of 1 μm or more of height-differentiating portions allow for obtainment of metal halide lamps which are free of occurrence of leaks until 2,000 hours. Further, depths D of 3.0 μm or more of height-differentiating portions allow for obtainment of metal halide lamps which are free of occurrence of leaks until 2,300 hours.

TABLE 3

| | Pitch P1 (μm) | | | | |
|---|---|---|---|---|---|
| | 600 | 400 | 200 | 150 | 100 |
| Leak occurrence rate (%) | 50 | 30 | 0 | 0 | 0 |

Table 3 shows leak occurrence rates upon conducting the EU mode test for five types having different pitches P1, each type being provided by twelve metal halide lamps. As seen from Table 2, pitches P1 of 200 μm or less allow for obtainment of metal halide lamps which are free of leaks until 2,000 hours insofar as in the EU rated mode.

Figure 10:
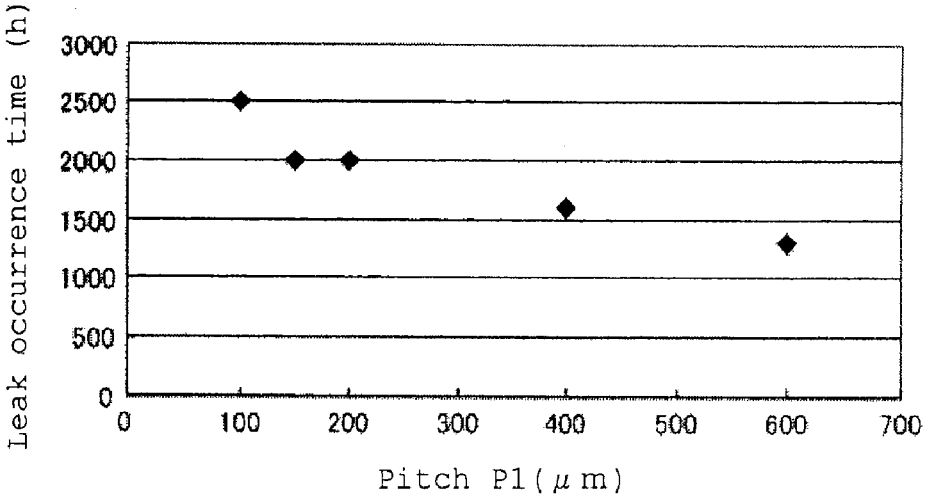
FIG. 10 is a graph of a relationship between a pitch P1 among a plurality of grooved portions and a leak occurrence time.

FIG. 10 is a graph showing a leak occurrence rate in twelve metal halide lamps belonging to each kind of metal halide lamp having different pitches P1 upon conducting the test in the EU mode. As seen from FIG. 10, pitches P1 of 200 μm or less between height-differentiating portions allow for obtainment of metal halide lamps which are free of occurrence of leaks until 2,000 hours insofar as in the EU rated mode. Further, pitches P1 of 100 μm or less allow for obtainment of metal halide lamps which are free of occurrence of leaks until 2,500 hours.

There will be explained other modes for implementing the metal halide lamps of the present invention with reference to FIG. 11 through FIG. 17. Note that the same components in each figure as those in FIG. 2 are accompanied by the same reference numerals or characters, and explanation thereof will be omitted.

Figure 11:
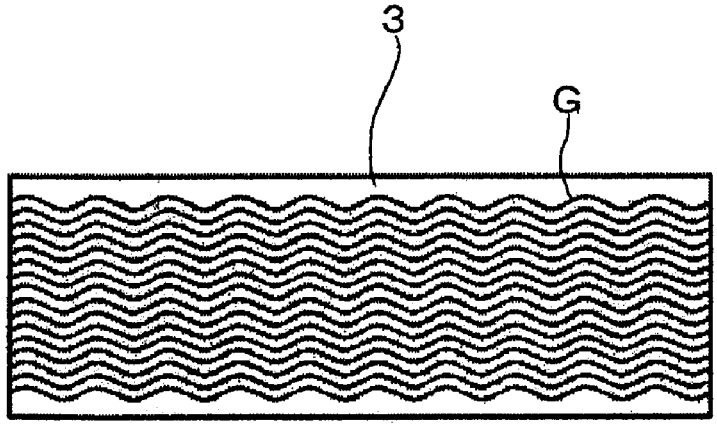
FIG. 11 is a front view of a surficial pattern of grooved portions formed at a surface of a sealed metal foil in a second mode for implementing a metal halide lamp of the present invention.

FIG. 11 is a front view of a surficial pattern of height-differentiating portions formed at a surface of a sealed metal foil in a second mode for implementing a metal halide lamp of the present invention. In this mode, the surficial pattern built up by multiple grooved portions G establishes wavy grooved portions G in shapes of continuously formed fine curves.

Thus, lengths of the grooved portions G in this mode are made longer than those of rectilinear grooved portions G, in a manner to promote retention of halides, thereby resultingly restrict migration of discharge medium.

Figure 12:
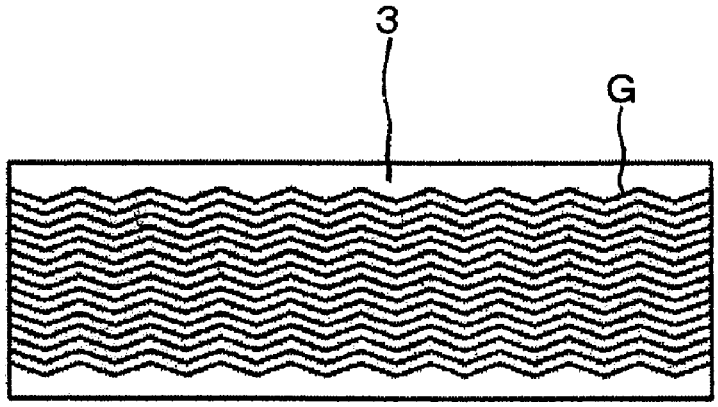
FIG. 12 is a front view of a surficial pattern of grooved portions formed at a surface of a sealed metal foil in a third mode for implementing a metal halide lamp of the present invention.

FIG. 12 is a front view of a surficial pattern of height-differentiating portions formed at a surface of a sealed metal foil in a third mode for implementing a metal halide lamp of the present invention.

In this mode, the surficial pattern of the height-differentiating portions establishes grooved portions G in shapes of continuously and angularly connected short straight lines.

Also in this mode, lengths of the grooved portions G are increased, in a manner to promote retention of halides at the grooved portions G, thereby resultingly restrict migration of discharge medium.

Figure 13:
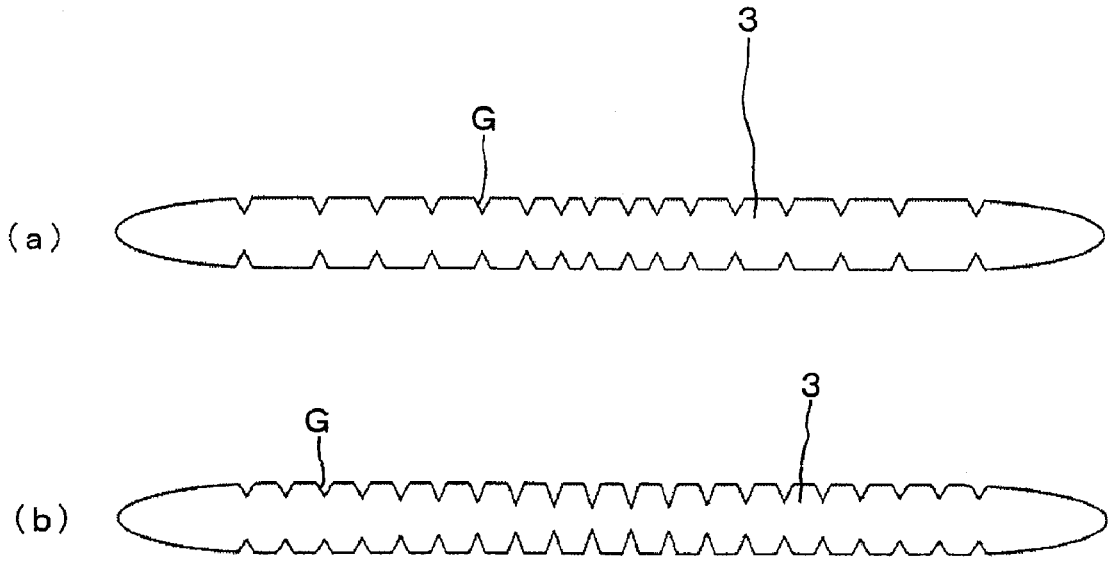
FIG. 13 is a transverse cross-sectional view of a configuration of a plurality of juxtaposed grooved portions formed on a surface of a sealed metal foil in a fourth mode for implementing a metal halide lamp of the present invention, in which FIG. 13(*a*) is an enlarged transverse cross-sectional view of neighbored grooved portions of varying pitches therebetween, and FIG. 13(*b*) is an enlarged transverse cross-sectional view of grooved portions of varying height differences.

FIG. 13 shows a fourth mode for implementing a metal halide lamp of the present invention, and FIG. 13(*a*) is an enlarged transverse cross-sectional view of a sealed metal foil where a plurality of juxtaposed and neighbored grooved portions formed on a surface of the sealed metal foil have varying pitches therebetween, and FIG. 13(*b*) is an enlarged transverse cross-sectional view of a sealed metal foil where a plurality of juxtaposed and neighbored grooved portions formed on a surface of the sealed metal foil have varying height differences.

In this mode shown in (a), the pitches of the plurality of juxtaposed and neighbored grooved portions formed on the foil surface are small at the central portion of the foil and become gradually large toward side edge portions of the foil.

In (b), the depths of the plurality of juxtaposed and neighbored grooved portions formed on the foil surface are large at the central portion of the foil and become gradually small toward side edge portions of the foil.

Figure 14:
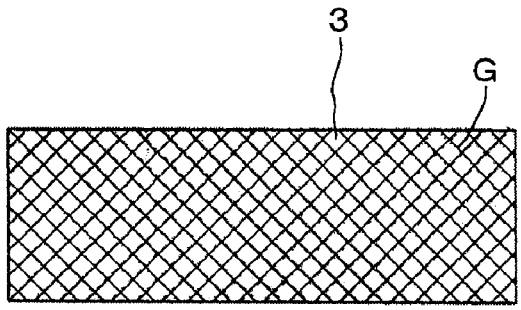
FIG. 14 is a front view of a surficial pattern of grooved portions formed at a surface of a sealed metal foil in a fifth mode for implementing a metal halide lamp of the present invention.

FIG. 14 is a front view of a surficial pattern of height-differentiating portions formed at a surface of a sealed metal foil in a fifth mode for implementing a metal halide lamp of the present invention. In this mode, the surficial pattern of the grooved portions G formed on the sealed metal foil 3 exhibits an inclined lattice pattern.

Since the grooved portions G in groove shapes exhibit the inclined lattice pattern, migration of halides tends to be obstructed, thereby restricting diffusion of discharge medium.

Figure 15:
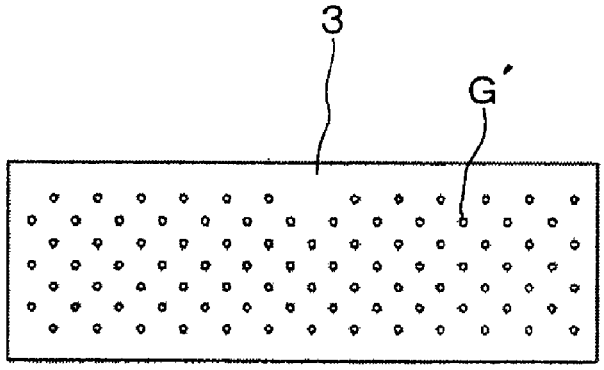
FIG. 15 is a front view of a surficial pattern of grooved portions formed at a surface of a sealed metal foil in a sixth mode for implementing a metal halide lamp of the present invention.

FIG. 15 is a front view of a surficial pattern of height-differentiating portions formed at a surface of a sealed metal foil in a sixth mode for implementing a metal halide lamp of the present invention. In this mode, the surficial pattern formed on the sealed metal foil 3 is constituted of multiple pitted portions G' arranged in a dispersed dot manner.

Since the multiple pitted portions G' are arranged in the dispersed dot manner, the grooved portions G each exhibit a function to store discharge medium therein, thereby restricting diffusion of discharge medium.

Figure 16:
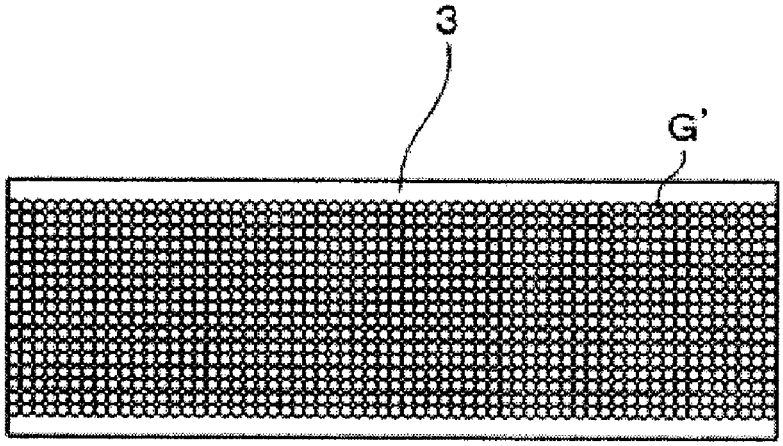
FIG. 16 is a front view of a surficial pattern of grooved portions formed at a surface of a sealed metal foil in a seventh mode for implementing a metal halide lamp of the present invention.
Figure 17:
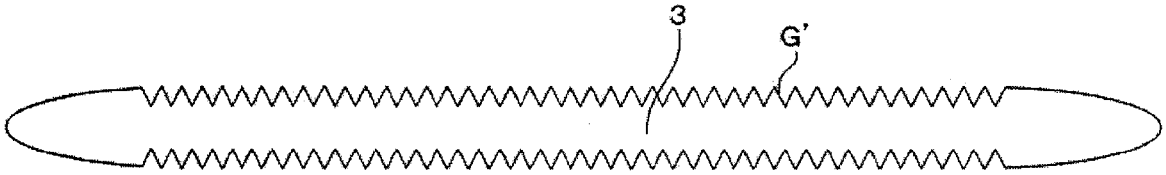
FIG. 17 is an enlarged transverse cross-sectional view of the same sealed metal foil as that in FIG. 16

FIG. 16 is a front view of a surficial pattern formed at a surface of a sealed metal foil in a seventh mode for implementing a metal halide lamp of the present invention, and FIG. 17 is an enlarged transverse cross-sectional view of the sealed metal foil in the seventh mode. In this mode of implementation, the surficial pattern is constituted of a plurality of pitted portions G' arranged in an intimate manner without overlapping. Note that the term "intimate" means such a state that no reference surfaces are left between neighboring pitted portions G', due to crater rims higher than the reference surface of the foil, which crater rims are to be raised around laser-irradiated portions, i.e., around the pitted portions G', respectively.

Since the plurality of pitted portions G' are arranged in the intimate manner without overlapping, the raised portions among neighboring pitted portions G' are made higher in a manner to allow definition of larger height differences, thereby restricting diffusion of discharge medium.

The invention claimed is:

1. A metal halide lamp comprising:

a light-transmitting hermetic vessel made of quartz glass, including: a surrounding portion having a discharge space formed therein; and at least one sealing portion joined to the surrounding portion;

electrodes sealed within the discharge space of the light-transmitting hermetic vessel;

a discharge medium filled within the discharge space of the light-transmitting hermetic vessel, and containing at least a halide of light emitting metal and a rare gas; and a sealed metal foil connected to a proximal end of an associated one of the electrodes and hermetically embedded within the sealing portion of the light-transmitting hermetic vessel, and wherein at a position away from a portion of the sealed metal foil connected to the associated electrode, the foil is formed with height-differentiating portions comprised of laser traces on at least one of surfaces of the metal foil.

2. The metal halide lamp according to claim 1, wherein the height-differentiating portions formed on the surface of the sealed metal foil define height differences exhibiting a surface roughness Ra (μm) satisfying a formula: $0.45 \leqq Ra$ and a surface roughness Rz (μm) satisfying a formula: $1.0. \leqq Rz \leqq 7.0$.

3. The metal halide lamp according to claim 1, wherein the height-differentiating portions formed on the surface of the sealed metal foil have depths D of 1 μm or more, respectively.

4. The metal halide lamp according to claim 1 or 2, wherein the height-differentiating portions formed on the surface of the sealed metal foil have widths W of 100 μm or less, respectively.

5. The metal halide lamp according to any one of claims 1 through 3, wherein neighboring ones of the height-differentiating portions of the sealed metal foil have pitches P1 of 200 μm or less.

6. The metal halide lamp according to any one of claims 1 through 3, wherein the height-differentiating portions formed on the surface of the sealed metal foil comprise multiple grooved portions, respectively, extending in a tube axis direction.

7. The metal halide lamp according to claim 6, wherein the grooved portions as the height-differentiating portions formed on the surface of the sealed metal foil are formed by continuous laser traces formed of laser spots, and wherein the laser spots have spot pitches P2 in the longitudinal direction of the grooved portions as the height-differentiating portions, such that the spot pitches P2 satisfy a formula: $R/2 \leqq P2 < R$ where R is a diameter of each laser spot.

8. The metal halide lamp according to claim 1, wherein the height-differentiating portions of the sealed metal foil are formed of a plurality of pitted portions, respectively, arranged in an intimate manner without overlapping.

9. The metal halide lamp according to claim 1, wherein the height-differentiating portions are formed on both obverse and reverse surfaces of the sealed metal foil, substantially over the whole areas thereof, respectively.

10. The metal halide lamp according to claim 1 or 2, wherein the discharge medium is substantially free of mercury.

11. The metal halide lamp according to claim 6, wherein the discharge medium is substantially free of mercury.

12. The metal halide lamp according to claim 7, wherein the discharge medium is substantially free of mercury.

13. The metal halide lamp according to claim 8, wherein the discharge medium is substantially free of mercury.

14. The metal halide lamp according to claim 9, wherein the discharge medium is substantially free of mercury.

* * * * *